US010520145B2

(12) United States Patent
Lin et al.

(10) Patent No.: US 10,520,145 B2
(45) Date of Patent: Dec. 31, 2019

(54) ANTIGLARE LED WALL LIGHT APPARATUS

(71) Applicant: TIVOLI, LLC, Tustin, CA (US)

(72) Inventors: Lien-Chung Lin, Brea, CA (US); Peter Jang, Corona, CA (US); Jim Hardaway, Lake Esinore, CA (US); Kevin Russell, Tustin, CA (US); Kathleen H. Kim, Anaheim, CA (US)

(73) Assignee: Tivoli, LLC, Tustin, CA (US)

( * ) Notice: Subject to any disclaimer, the term of this patent is extended or adjusted under 35 U.S.C. 154(b) by 0 days.

(21) Appl. No.: 16/137,485

(22) Filed: Sep. 20, 2018

(65) Prior Publication Data

US 2019/0086041 A1 Mar. 21, 2019

Related U.S. Application Data

(60) Provisional application No. 62/560,991, filed on Sep. 20, 2017.

(51) Int. Cl.

| | |
|---|---|
| ***F21S 8/02*** | (2006.01) |
| ***F21V 7/00*** | (2006.01) |
| ***F21K 9/68*** | (2016.01) |
| ***F21Y 115/10*** | (2016.01) |
| ***F21S 8/00*** | (2006.01) |
| ***F21S 4/28*** | (2016.01) |
| *F21Y 103/10* | (2016.01) |

(52) U.S. Cl.

CPC ..... *F21S 8/024* (2013.01); *F21K 9/68* (2016.08); *F21S 4/28* (2016.01); *F21S 8/033* (2013.01); *F21V 7/005* (2013.01); *F21V 7/0008* (2013.01); *F21V 7/0041* (2013.01); *F21V 7/0091* (2013.01); *F21Y 2103/10* (2016.08); *F21Y 2115/10* (2016.08)

(58) Field of Classification Search

CPC ... F21S 8/024; F21S 8/033; F21S 4/28; F21V 7/0091; F21V 7/0008; F21V 7/0016; F21V 7/0041; F21V 7/005; F21K 9/68; F21Y 2115/10; F21Y 2103/10

See application file for complete search history.

(56) References Cited

FOREIGN PATENT DOCUMENTS

KR 20120069386 A * 6/2012

* cited by examiner

*Primary Examiner* — Joseph L Williams
*Assistant Examiner* — Jose M Diaz
(74) *Attorney, Agent, or Firm* — Loza & Loza, LLP; Heidi Eisenhut

(57) ABSTRACT

An antiglare LED wall light apparatus is provided. The apparatus comprises an elongated base member; an elongated shield detachably secured to the base member; a light source mounted within the shield; and baffles secured to the shield at horizontally spaced apart intervals. The shield comprises an elongated body having an inner surface and an opposing outer surface, the body extending outwardly and vertically downward from an upper end of the body to a lower end of the body; an arcuate tab integrally connected to the upper end of the body; a vertical member extending downwardly from the inside surface of the body; an upper ledge extending horizontally outward from an upper end of the vertical member, the upper end fixedly attached to the body; and a lower ledge extending horizontally outward from a lower end of the vertical member, the lower ledge parallel to the upper ledge forming a mounting channel.

20 Claims, 10 Drawing Sheets

ANTIGLARE LED WALL LIGHT APPARATUS

CLAIM OF PRIORITY UNDER 35 U.S.C. § 119

The present application for patent claims priority to U.S. Provisional Application No. 62/560,991 entitled "Antiglare LED Wall Light Apparatus", filed Sep. 20, 2018, and assigned to the assignee hereof and hereby expressly incorporated by reference herein.

FIELD

This present disclosure relates to an antiglare light emitting diode (LED) wall light apparatus and more specifically to a lighting device with one or more LEDs that project light to a reflector to direct the reflected light to desired illumination area such as illuminating a ground area instead of illuminating a wall.

BACKGROUND

In lighting, glare is a visual sensation caused by excessive and uncontrolled brightness. It can be disabling or simply uncomfortable. For example, in theaters the aisles are required to have a minimum illumination 0.2 foot candle (fc) to meet safety codes in the event of an emergency. Without the proper illumination, individuals may not be able to find an exit.

Popular illumination devices in theaters are wall lights mounted to a vertical surface, such as a wall or seats on one or both sides of the aisle, to provide enough illumination for individuals to be able to see the landing, or steps, of the aisle.

Currently, the designs of wall lights use an LED light source as the direct lighting which results in a glare to the screen and individuals in the audience. When individuals observe a visual object or screen, if there is a high brightness light-emitting object field of view, it will affect the observed effect, and distract the individuals and make them uncomfortable. As LED light sources have a small size and high brightness characteristics, it is easy to produce glare.

In view of the above, what is needed is a fixture or an antiglare LED wall light apparatus which is designed to prevent glare and direct the illumination of light to a specific area. As discussed in detail below, the present disclosure provides a specifically arranged structure to prevent glare by shielding the light source with a plurality of baffles which in turn effectively achieves the effort of preventing glare. The design of the present disclosure is a simplified optical system that does not need additional optical lenses, is easy to manufacture, easy to assemble, and is cost effective.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature, an antiglare LED wall light apparatus is provided. The antiglare LED wall light apparatus comprises an elongated base member; an elongated shield detachably secured to the elongated base member; one or more light sources mounted within the elongated shield at horizontally spaced apart intervals; and one or more pairs of baffles one or more baffles secured to the elongated shield at horizontally spaced apart intervals, where each light source in the one or more light sources is located between a pair of baffles in the one or more pairs of baffles.

According to one aspect, the elongated shield comprises an elongated body having an inner surface and an opposing outer surface, the elongated body extending outwardly and vertically downward from an upper end of the elongated body to a lower end of the elongated body; an arcuate tab integrally connected to the upper end of the elongated body; a vertical member extending downwardly from the inside surface of the elongated body; an upper ledge extending horizontally outward from an upper end of the vertical member, the upper end fixedly attached to the elongated body; and a lower ledge extending horizontally outward from a lower end of the vertical member, the lower ledge parallel to the upper ledge forming a mounting channel, the mounting channel configured to receive the one or more light sources.

According to another aspect, the light source includes an upper mounting tab and a lower mounting tab.

According to yet another aspect, the upper mounting tab is received under a lip of the upper ledge of the mounting channel; and wherein the lower mounting tab is received over a lip of the lower ledge of the mounting channel securing the light source to the elongated shield.

According to yet another aspect, the elongated shield further comprises a locking ledge integrally connected to and extending outwardly from the elongated body of the elongated shield, the locking edge located below the upper ledge of the elongated body.

According to yet another aspect, the one or more baffles are secured to the elongated shield by the upper ledge and the locking ledge.

According to yet another aspect, wherein the elongated base member comprises: a vertical support member; a top ledge extending outwardly from a top end of the vertical support member; and a bottom ledge extending outwardly from the vertical support member, the bottom ledge separated from the top ledge by a distance forming a locking channel.

According to yet another aspect, the elongated shield comprises: an elongated body having an inner surface and an opposing outer surface, the elongated body extending outwardly and vertically downward from an upper end of the elongated body to a lower end of the elongated body; an arcuate tab integrally connected to the upper end of the elongated body, the arcuate tab inserted into the locking channel to secure the elongated shield to the elongated base member.

According to yet another aspect, the top ledge of the elongated base member includes a top ledge extension member integrally connected to an outer end of the top ledge and extending downwardly; wherein the bottom ledge of the elongated base member includes a bottom ledge extension member integrally connected to an outer end of the bottom ledge and extending upwardly; and wherein the top ledge extension and the bottom ledge extension maintain the arcuate tab within the locking channel.

According to yet another aspect, the arcuate tab of the elongated shield is detachably secured to the elongated base member.

According to yet another aspect, the elongated base member further comprises an arcuate support member integrally connected to a bottom end of the vertical support member, the arcuate support member configured to the shape of the one or more baffles.

According to yet another aspect, the elongated base member further comprises an arcuate support member integrally connected to a bottom end of the vertical support member, the arcuate support member configured to the shape of the one or more baffles.

According to yet another aspect, each baffle in the one or more pairs of baffles comprise: an upper tab adapted to mount onto the upper ledge of the elongated body of the shield; a middle tab adapted to mount onto a locking ledge, the locking ledge integrally connected to and extending outwardly from the elongated body of the elongated shield; and a lower tab adapted to mount onto a lower portion of the arcuate support member.

According to yet another aspect, the light source comprises: a holder having an upper portion and a lower portion, where the upper portion is separated from the lower portion by separating member; and a LED board adapted for insertion into the upper portion of the holder.

According to yet another aspect, the apparatus further comprises one or more wires extending through the lower portion of the holder, the one or more wires providing power to the LED board.

According to yet another aspect, the lower portion of the holder snaps onto the one or more wires.

According to yet another aspect, the LED board includes a slot for enabling removal of the LED board from the holder.

According to yet another aspect, the base member further comprises: one or more horizontal members integrally connected to extending perpendicularly outward from the vertical support member.

According to yet another aspect, the base member further comprises: a first horizontal member integrally connected to and extending perpendicularly outward from the vertical support member; a second horizontal member integrally connected to and extending perpendicularly outward from the vertical support member, the second horizontal member parallel to the first horizontal member; and a vertical structural member integrally connected to outer ends of the first and second horizontal members.

BRIEF DESCRIPTION OF THE DRAWINGS

The features, nature, and advantages of the present aspects may become more apparent from the detailed description set forth below when taken in conjunction with the drawings in which like reference characters identify correspondingly throughout.

DETAILED DESCRIPTION

The present disclosure will now be described in detail with reference to the accompanying drawings. In the following description, numerous specific details are set forth in order to provide a thorough understanding of the aspects described herein. It will be apparent, however, to one skilled in the art, that these and other aspects may be practiced without some or all of these specific details. In other instances, well known process steps and/or structures have not been described in detail in order to not unnecessarily obscure the description.

The word "exemplary" is used herein to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage, or mode of operation.

While the antiglare light emitting diode (LED) wall light apparatus of the present disclosure is described primarily with respect to use in an indoor movie theatre, the antiglare LED wall light apparatus of the present disclosure may be applied and adapted to various structures, both indoor and outdoor structures. The apparatus of the present disclosure may be utilized in hotels, schools, churches, apartment buildings, condominiums, auditoriums, individual homes, mobile homes, patios and anywhere else there is a need for lighting. Also, a variety of other embodiments are contemplated having different combinations of the below described features of the apparatus of the present disclosure, having features other than those described herein, or even lacking one or more of those features. As such, it is understood that the apparatus can be carried out in various other suitable modes.

The term "baffle" may refer to any device used to soften the effects of light and where the device has anti-glare properties for helping an individual concentrate or relax in a gently-lit environment, for example. The "baffle" may be used to direct the illumination of light to specific areas such as illuminating the ground while preventing the illumination of the wall in which the antiglare LED wall light apparatus is secured to.

Antiglare LED Wall Apparatus—First Example

Figure 1:
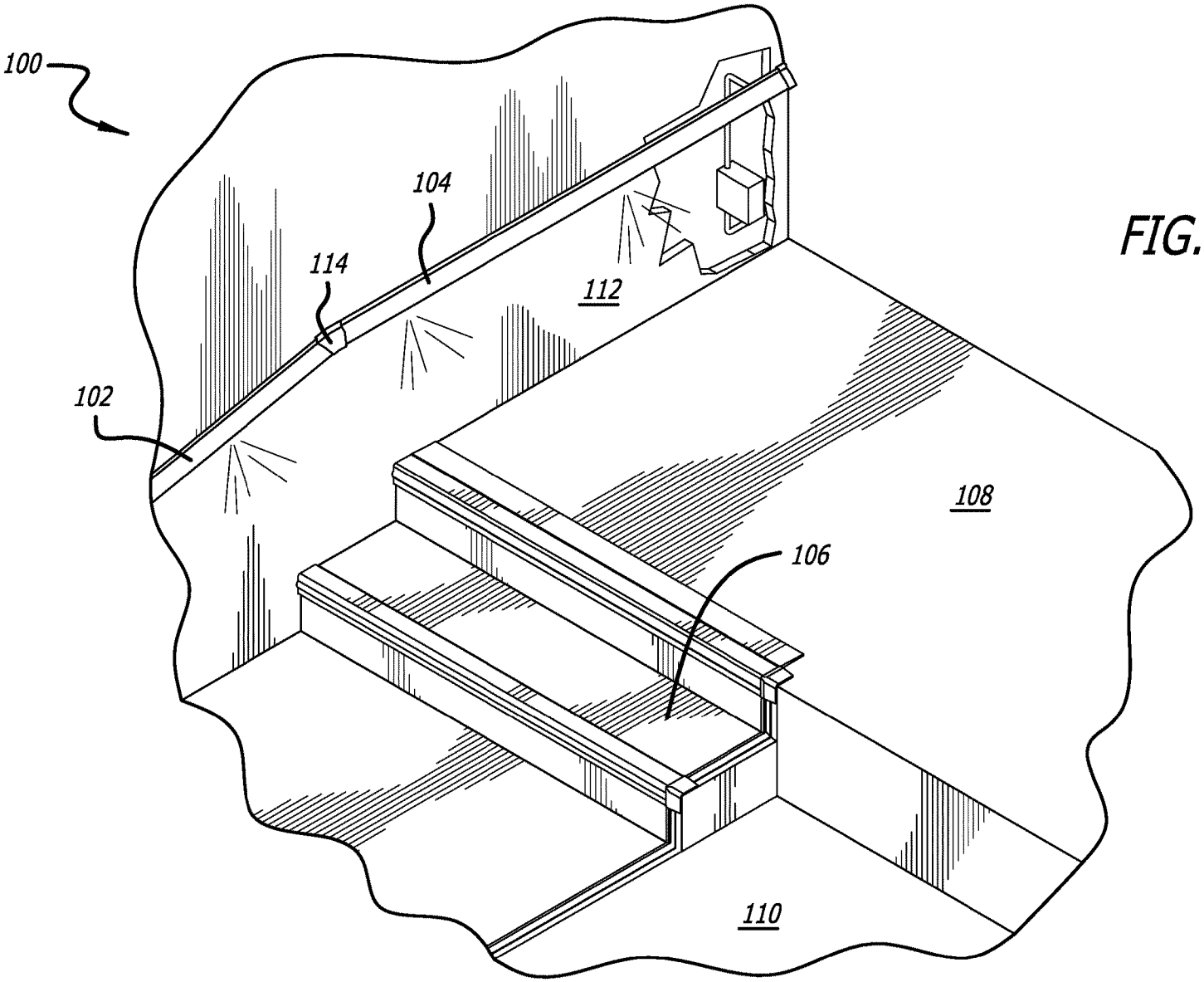
FIG. 1 illustrates a pair of an antiglare LED wall light apparatuses shown in an environmental use of a theatre.

FIG. 1 illustrates a partial view of an indoor structure 100 utilizing a pair of antiglare LED wall light apparatuses 102, 104 of the present disclosure. Although the antiglare LED wall light apparatus is shown used in an indoor structure, the antiglare LED wall light apparatus may also be used in outdoor structures. The indoor structure 100 shown in FIG. 1 may be a movie theatre. As is typical in a lot of movie theatres, stairs 106 may be utilized to ascend to various floors or platforms 108 where each platform 108 has a series of seats for individuals to sit in while watching the movie. Each series of seats may be located on a different platform and the platforms increase in vertical distance from a main floor.

When the movie begins lights inside the theatre are dimmed for better viewing of the movie. However, to allow individuals to enter or exit the theatre after the lights have dimmed, the pair of antiglare LED wall light apparatuses 102, 104 are mounted on a wall 112 adjoining the stairs 106 to provide enough light for the individual to avoid any obstacles. As can be seen in FIG. 1, the pair of antiglare LED wall light apparatuses 102, 104 may be connected together with by a cover joiner 114.

Figure 2:
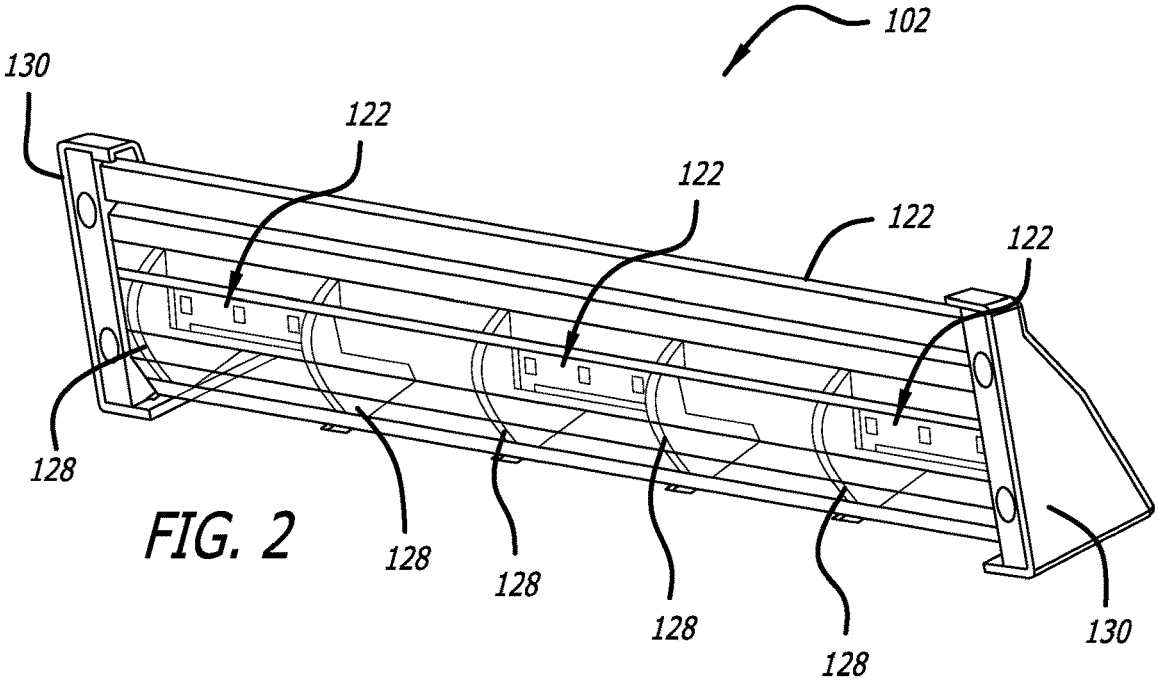
FIG. 2 is a rear perspective view of an antiglare LED wall light apparatus according to an aspect of the present disclosure.
Figure 3:
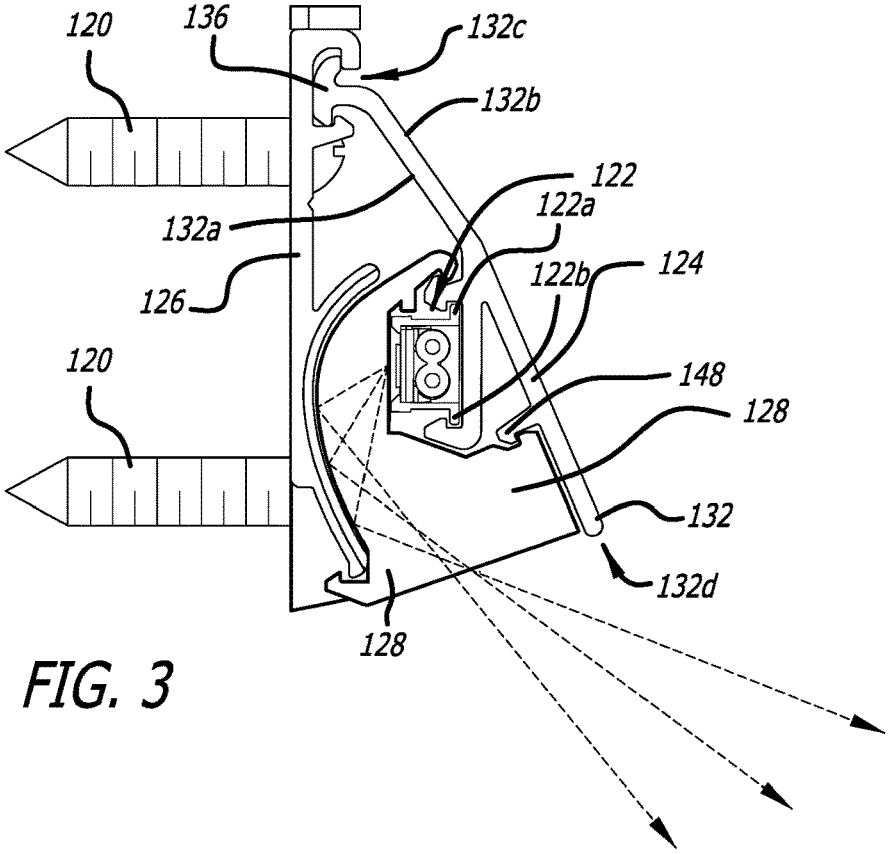
FIG. 3 is a side elevation view of the antiglare LED wall light apparatus of FIG. 2.
Figure 4:
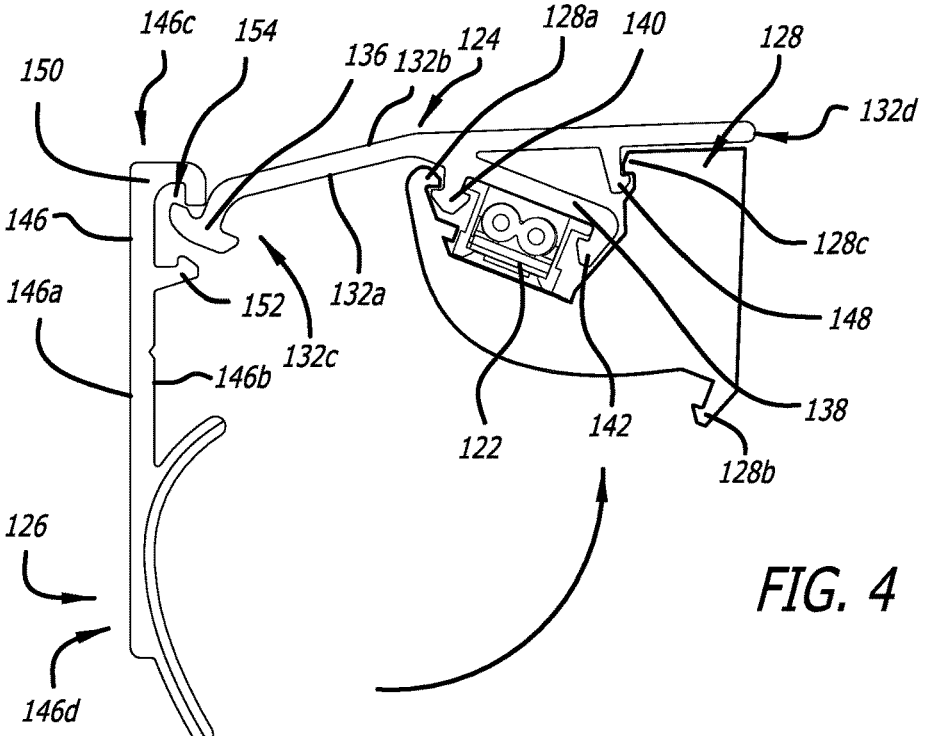
FIG. 4 is a side view of a shield having a light source being secured to a base member forming the antiglare LED wall light apparatus of FIG. 3.

FIG. 2 is a rear perspective view of the antiglare LED wall light apparatus 102 according to an aspect of the present disclosure. FIG. 3 is a side elevation view of the antiglare LED wall light apparatus of FIG. 2. FIG. 4 is a side view of the shield with the light source being secured to the base member of the antiglare LED wall light apparatus of FIG. 3. The following discussion refers interchangeably to FIGS. 2-4.

As shown, the antiglare LED wall light apparatus 102 may be secured to base members 126, as described in more detail below, which may then be affixed to a wall with screws 120. The antiglare LED wall light apparatus 102 may comprise a light source 122 mounted within a mounting channel 144 of a shield 124 which is secured to a base member 126 as described in more detail below. A plurality of baffles 128 may be secured at horizontally spaced apart intervals along an interior surface of the shield 124. The plurality of baffles 128 at horizontally spaced apart intervals can be seen in FIG. 2. Cover end caps 130 may be utilized to cover an open channel within the antiglare LED wall light apparatus at either end of the run where the run is two or more antiglare LED wall light apparatuses joined together by cover joints. Alternatively, end caps may be utilized at both ends of a single antiglare LED wall light apparatus.

FIG. 4 is a side view of the shield with the light source 122 being secured to the base member 126 of the antiglare LED wall light apparatus of FIG. 3. As shown, the shield 124 has an elongated body 132 having an inner surface 132*a* and an opposing outer surface 132*b*, the elongated body extends vertically outward from an upper end 132*c* of the elongated body 132 to a lower end 132*d* of the elongated body 132. An arcuate tab 136 is integrally connected to the upper end 132*c* of the elongated body 132 and adapted for securing within a channel 154 of the base member 126 as described below in more detail. A vertical member 138 extends downwardly from the inside surface 132*a* of the elongated body 132 and an upper ledge 140 extends horizontally outward from an upper end of the vertical member 138 and a lower ledge 142 extends horizontally outward from a lower end of the vertical member 138. The upper ledge 140 and the lower ledge 142 may be parallel to each other forming a mounting channel. The light source 122 may be adapted for mounting within the mounting channel. The light source 122 may have an upper mounting tab 122*a* and a lower mounting tab 122*b* configured to be received under a lip of the upper ledge 140 of the mounting channel and a lip of the lower ledge 142 of the mounting channel 144. The shield 124 may also include a locking ledge 148 for securing a baffle 128 to the shield 124 as described in more detail below.

The base member 126 may comprise an elongated back support 146 having an inner surface 146*b* and an outer surface 146*a* extending vertically downward from an upper end 146*c* to an opposing lower end 146*d*. (See FIG. 4) The upper end 146*c* of the elongated back support 146 may include a top ledge 150 and a bottom ledge 152 forming a locking channel 154 adapted to receive the arcuate tab 136 of the shield 124 securing the shield 124 to the base member 126. The arcuate tab 136 allows the shield 124 to be rotated into place. An arcuate support member 156 may be located on the lower end 146*d* of the elongated back support 146 and configured to the shape of the baffle 128. The baffle 128, having an upper tab 128*a*, a middle tab 128*b* and a lower tab 128*c*, may be placed over the light source 122 and secured to the shield 124 such that the upper tab 128*a* hooks over the upper ledge 140 of the shield 124 and the middle tab 128*b* hooks over the locking ledge 148 securing the baffle 128 to the shield 124. As the shield 124 is rotated into place, the baffle 128 is received into the arcuate support member 156 and the lower tab 128*c* of the baffle 128 locks onto the arcuate support member 156 securing the shield 124 and baffle 128 to the base member 126.

Antiglare LED Wall Apparatus—Second Example

Figure 5:
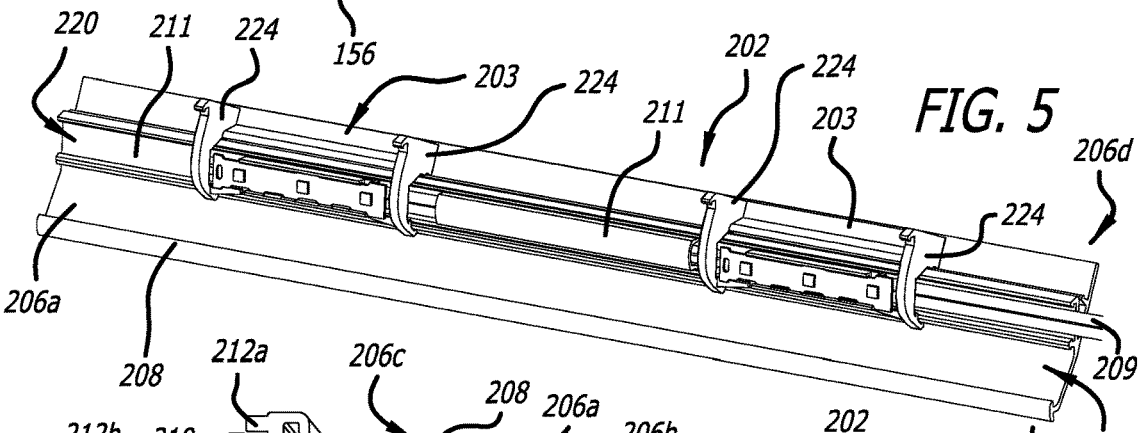
FIG. 5 illustrates a rear perspective view of a shield of an antiglare LED wall light apparatus according to an aspect of the present disclosure
Figure 6:
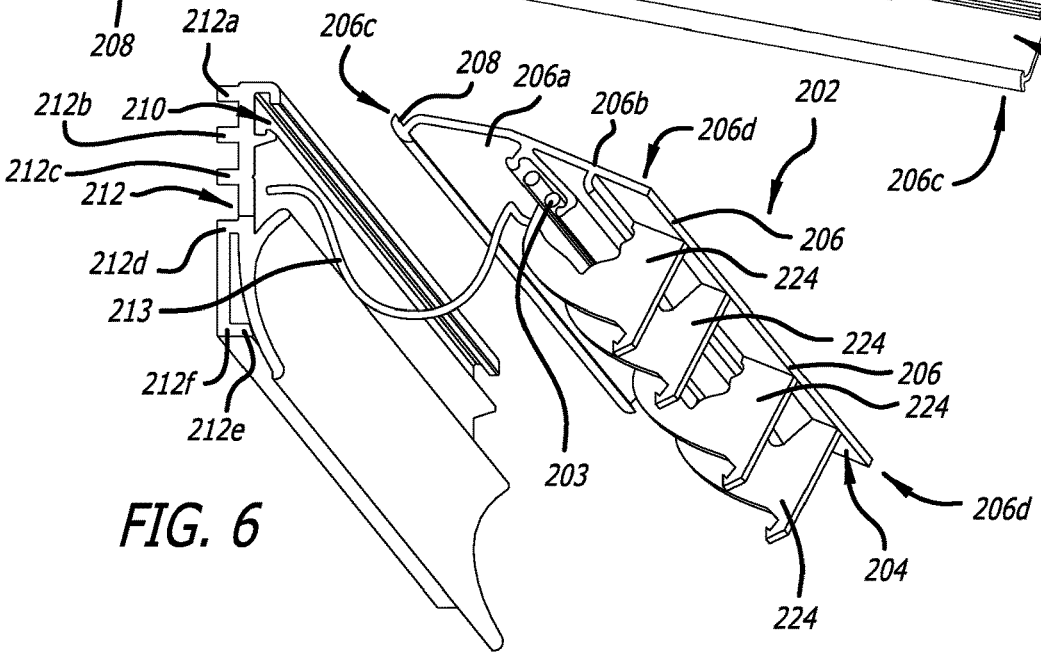
FIG. 6 illustrates a bottom perspective exploded view of the shield and base member of the antiglare LED wall light apparatus.
Figure 7:
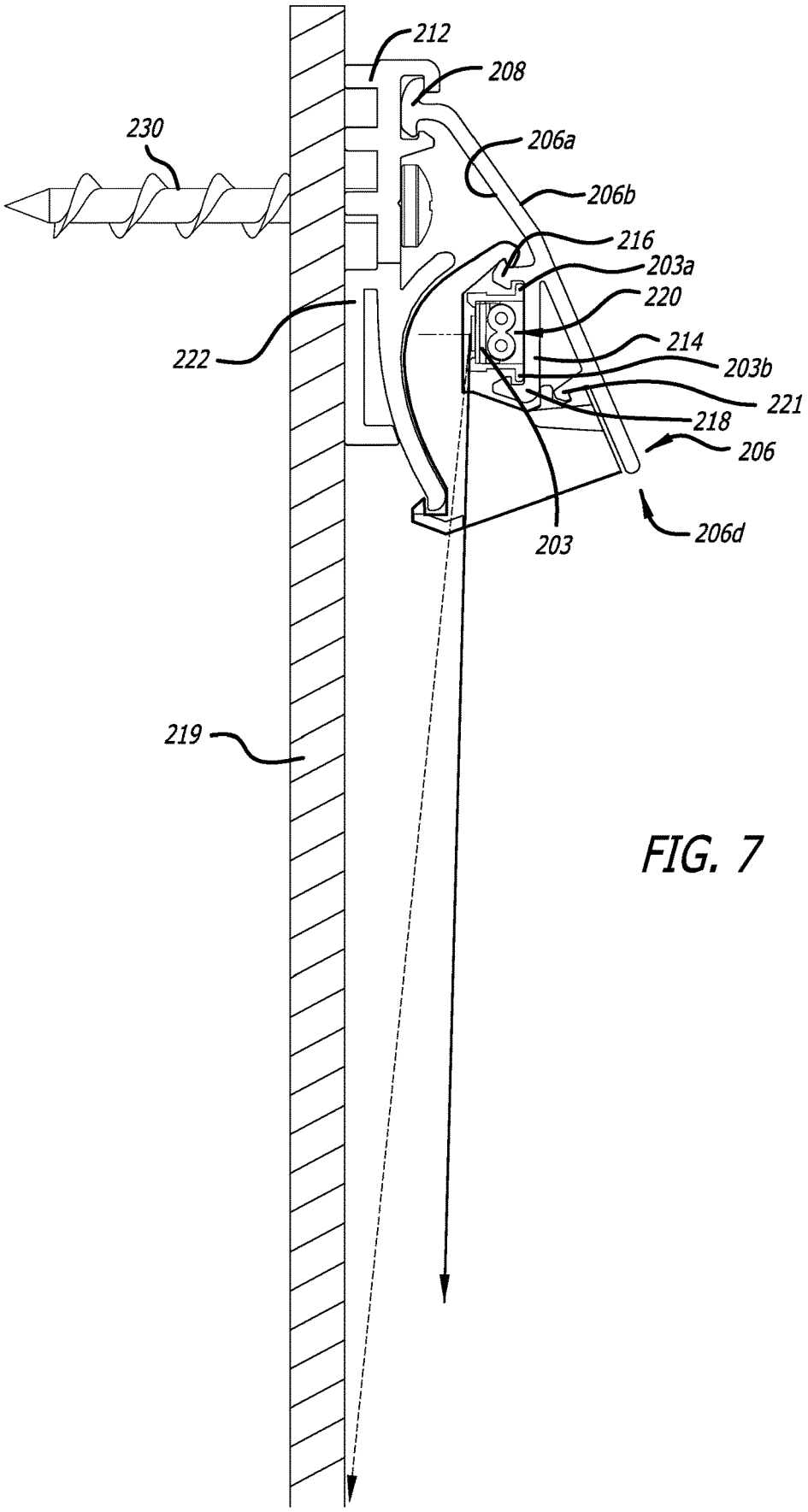
FIG. 7 illustrates an antiglare LED wall light apparatus mounted to a wall.
Figure 8:
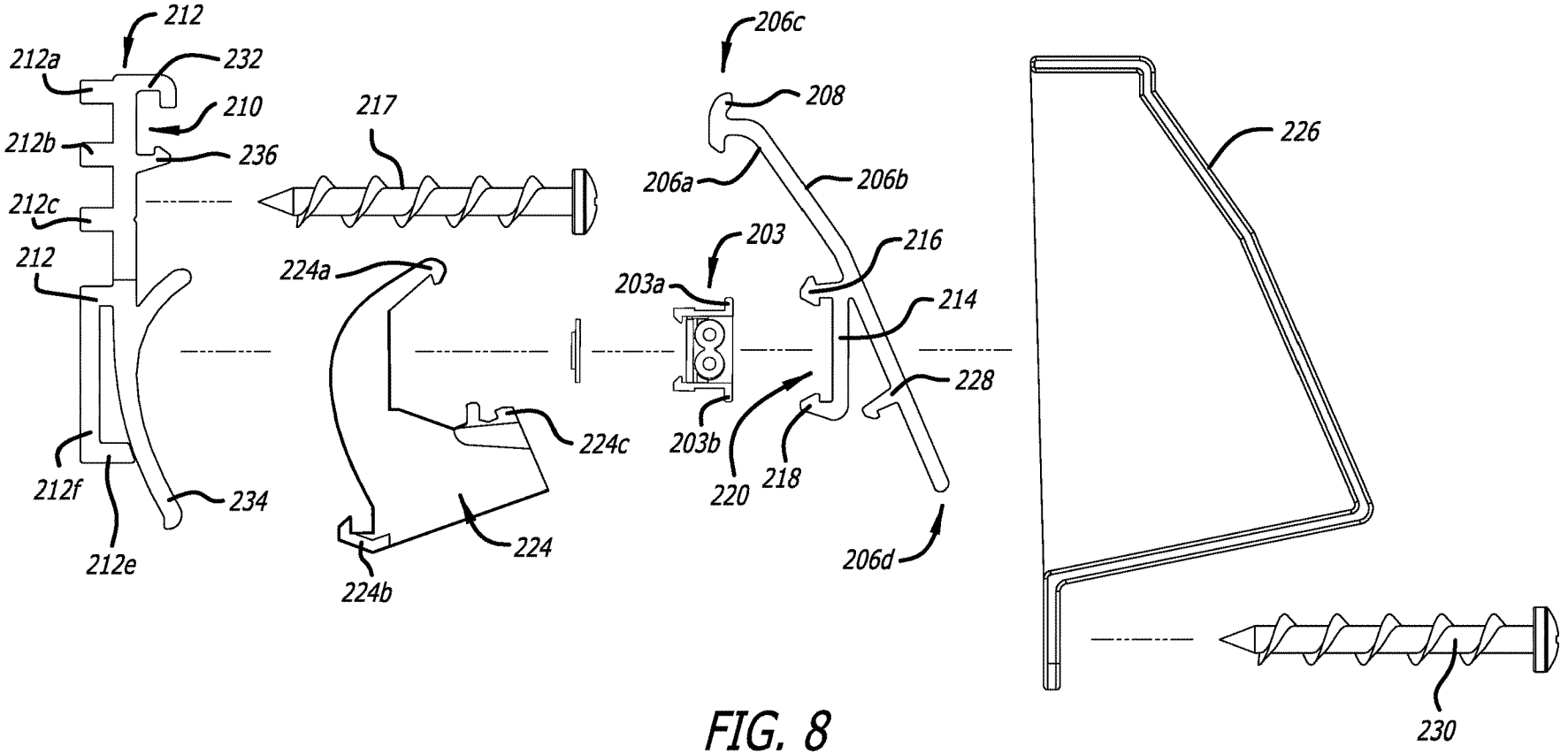
FIG. 8 illustrates an exploded view of the antiglare LED wall light apparatus in FIG. 7.
Figure 9:
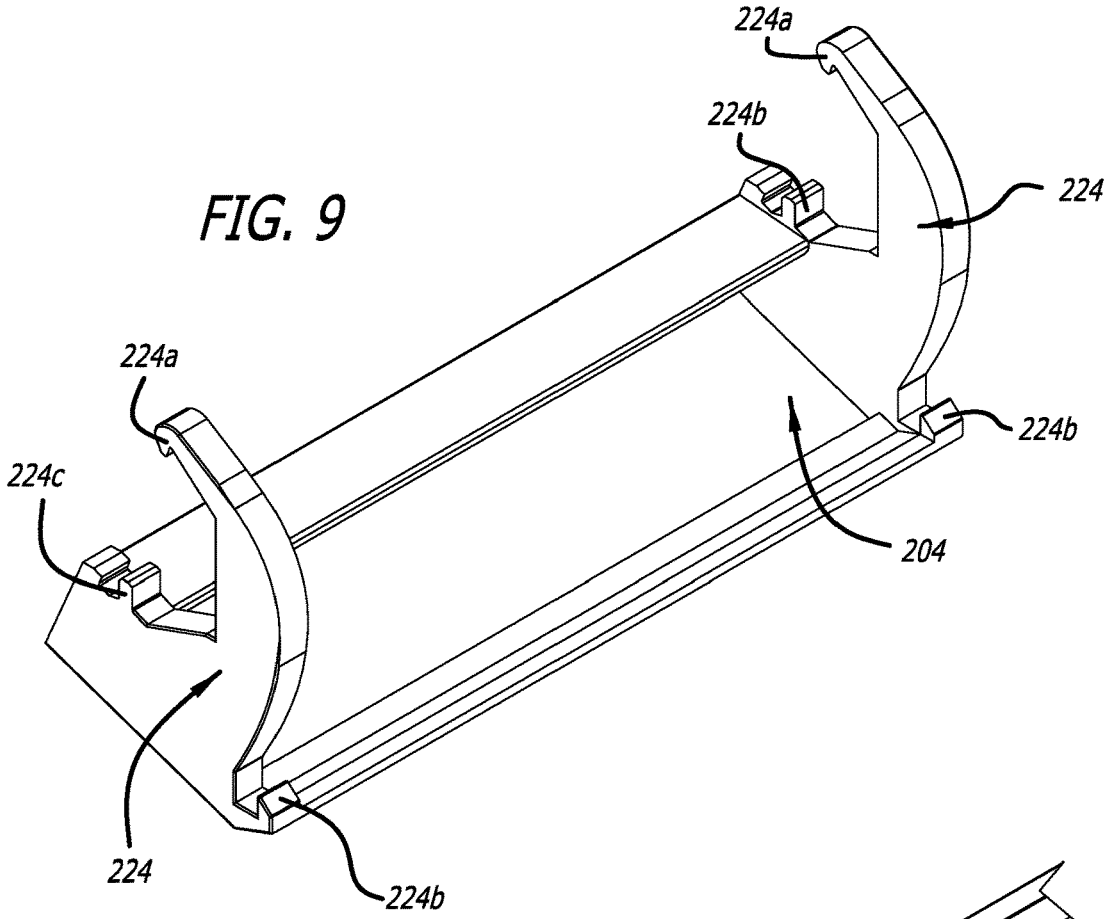
FIG. 9 illustrates a pair of baffles secured to the elongated body of the shield.

FIG. 5 illustrates a rear perspective view of a shield 204 of an antiglare LED wall light apparatus 202 according to an aspect of the present disclosure. FIG. 6 illustrates a bottom perspective exploded view of the shield and base member of the antiglare LED wall light apparatus 202. FIG. 7 illustrates the antiglare LED wall light apparatus mounted to a wall. FIG. 8 illustrates an exploded view of the antiglare LED wall light apparatus in FIG. 7. FIG. 9 illustrates a pair of baffles secured to the elongated body of the shield. FIG. illustrates an end cap for mounting to an antiglare LED wall light apparatus according to an aspect. The following discussion refers interchangeably to FIGS. 5-10.

The antiglare LED wall light apparatus 202 may comprise one or more light sources 203 mounted within a mounting channel 220 of a shield 204 which is secured to a base member 212 as described in more detail below. As shown, the base member 212 may include one or more structural members 212*a*-212*f* (See FIG. 8) to provide structure and rigidity to the apparatus. According to one example, the structural members 212*a*-212*f* may be horizontal members 212*a*, 212*b*, and 212*c* extending perpendicularly outward from the base member 212 and/or a pair of horizontal members 212*d* and 212*e* integrally connected by a vertical support member 212*f*.

The shield 204 may comprise an elongated body 206 having an inner surface 206*a* and an opposing outer surface 206*b*, the elongated body 206 extends vertically outward from an upper end 206*c* of the elongated body 206 to a lower end 206*d* of the elongated body 206. The shield 204 may further include a mounting channel 220 for mounting one or more light sources 203. Although two light sources 203 are shown, this is by way of example only and one light source 203 may be utility or more than two light sources 203 may be utilized. The spacing between the light sources 203 may be variable allowing a user to mount the light sources 203 at the locations needed to provide adequate light. Each of the light sources 203, as shown in FIG. 5, are located between a pair of baffles 224 for softening the light emitting from the light sources 203 by preventing anti-glare properties from the light sources 203 which in turn helps an individual concentrate or relax in a gently-lit environment. As shown in FIG. 7, light is emitted from the light source 203 and the baffles 224 direct the light in a down and outwardly direction preventing glare. As described in more detail below, the structural configuration of the baffles 224 allow some of the light emitted from the light sources 203 to be blocked from hitting a wall 219 on which the apparatuses 202 are mounted so that all the light is emitted straight down to the ground and does not illuminate the wall 219. The antiglare LED wall light apparatus 202 may be secured to the base member 212 which may be affixed to the wall 219 with screws 230.

One or more wires (or cables) 209 may be located in, and extended within, the mounting channel 220 for providing power to the LEDs in the light sources 203. As shown in FIG. 5, covers 211 may be placed over the wires 209 where light sources 203 are not mounted to protect the wires or cables 209. For purposes of illustration, a portion of the wires 209 is shown without a cover. In FIG. 6, the antiglare LED wall light apparatus 202 is shown separated from the base member 212. A lead wire 213 may extend through a hole in the base member 212 and connect to the wires 209 which provides power to the one or more LED in the light sources 203.

An arcuate tab 208 is integrally connected to the upper end 206*c* of the elongated body 206 and adapted for securing within a locking channel 210 of the base member 212. The base member 212 may comprise an elongated vertical support member having an inner surface and an outer surface extending vertically downward from an upper end to an opposing lower end. The upper end of the elongated vertical support member may include a top ledge 232 and a bottom ledge 236 separated by a distance forming the locking channel 210 which is adapted to receive the arcuate tab 208 of the shield 204 securing the shield 204 to the base member 212. The arcuate tab 208 allows the shield 204 to be rotated into place. The outer ends of both the top ledge 232 and the bottom edge 236 have extensions extending downward and upward, respectively, allowing the arcuate tab 208 to securely remain in the locking channel 210.

A vertical member 214 extends downwardly from the inside surface 206*a* of the elongated body 206 and an upper ledge 216 extends horizontally outward from an upper end of the vertical member 214 and a lower ledge 218 extends horizontally outward from a lower end of the vertical member 214. The upper ledge 216 and the lower ledge 218 may be parallel to each other forming the mounting channel 220.

The light source 203 may be adapted for mounting within the mounting channel 220. The light source 203 may have an upper mounting tab 203*a* and a lower mounting tab 203*b* configured to be received under a lip of the upper ledge 216 of the mounting channel 220 and a lip of the lower ledge 218 of the mounting channel 220. The shield 204 may also include a locking ledge 228 for securing a baffle 224 to the shield 204 as described in more detail below.

The antiglare LED wall light apparatus 202 may comprise one or more light sources 203 mounted within a mounting channel 220 of the shield 204 and secured to a base member 212 as described in more detail below. A plurality of baffles 224 may be secured at horizontally spaced apart intervals along an interior surface of the shield 204. The plurality of baffles 224 at horizontally spaced apart intervals as can be seen in FIG. 5 which illustrates a rear view of the shield 204 of an antiglare LED wall light apparatus having a plurality of light source 203. Cover end caps 226 may be utilized to cover an open channel within the antiglare LED wall light apparatus at either end of the run where the run is two or more antiglare LED wall light apparatuses joined together by cover joints. Alternatively, end caps may be utilized at both ends of a single antiglare LED wall light apparatus.

As can be seen in FIG. 8, the light source 203 may have an upper mounting tab 203*a* and a lower mounting tab 203*b* configured to be received under a lip of the upper ledge 216 of the mounting channel 220 and a lip of the lower ledge 218 of the mounting channel 220. The shield 204 may also include a locking ledge 228 for securing a baffle to the shield 204 as described in more detail below.

An arcuate support member 234 may be located on the lower end 212*d* of the elongated vertical support member of the elongated base member 212 and configured to the shape of the baffle 224. The baffle 224, having an upper tab 224*a*, a middle tab 224*b* and a lower tab 224*c*, may be placed over the light source 203 and secured to the shield 204 such that the upper tab 224*a* hooks over the upper ledge 216 of the shield 204 and the middle tab 224*b* hooks over the locking ledge 228 securing the baffle 224 to the shield 204. As the shield 204 is rotated into place, the baffle 224 is received into the arcuate support member 234 and the lower tab 224*c* of the baffle 224 locks onto the arcuate support member 156 securing the shield 204 and baffle 224 to the base member 212.

FIG. 9 illustrates a pair of baffles 224 secured to the elongated body 206 of the shield 204. As shown, an opening is located between the pair of baffles for placement of a light source. As described previously, the light source may be clamped onto the wires. As shown in FIG. 7, light is emitted from the light source 203 and the baffles 224 direct the light in a down and outwardly direction preventing glare. The structural configuration of the baffles 224 allows some of the light emitted from the light source 203 to be blocked from hitting the wall 219 so that all the light is emitted straight down to the ground and does not illuminate the wall 219. More specifically, the middle tab 224*b* of the baffle 224 causes light emitted from the light source 203 directed to the wall 219 to be blocked. The dashed line in FIG. 7 coming down from the center line of the light source shows that this light would hit the middle tab 224*b* of the baffle and be blocked from hitting the wall 219. In other words, the middle tab 224*b* of the baffle 224 shades the light so that no light can hit the wall 219 as any light emitted at an angle that would hit the wall 219 is blocked by the middle tab 224*b* of the baffle 224 and any light emitted that does not hit the middle tab 224*b* of the baffle 224 would go straight down to the ground and not illuminate the wall. This provides for ground illumination with no wall illumination.

Figure 10:
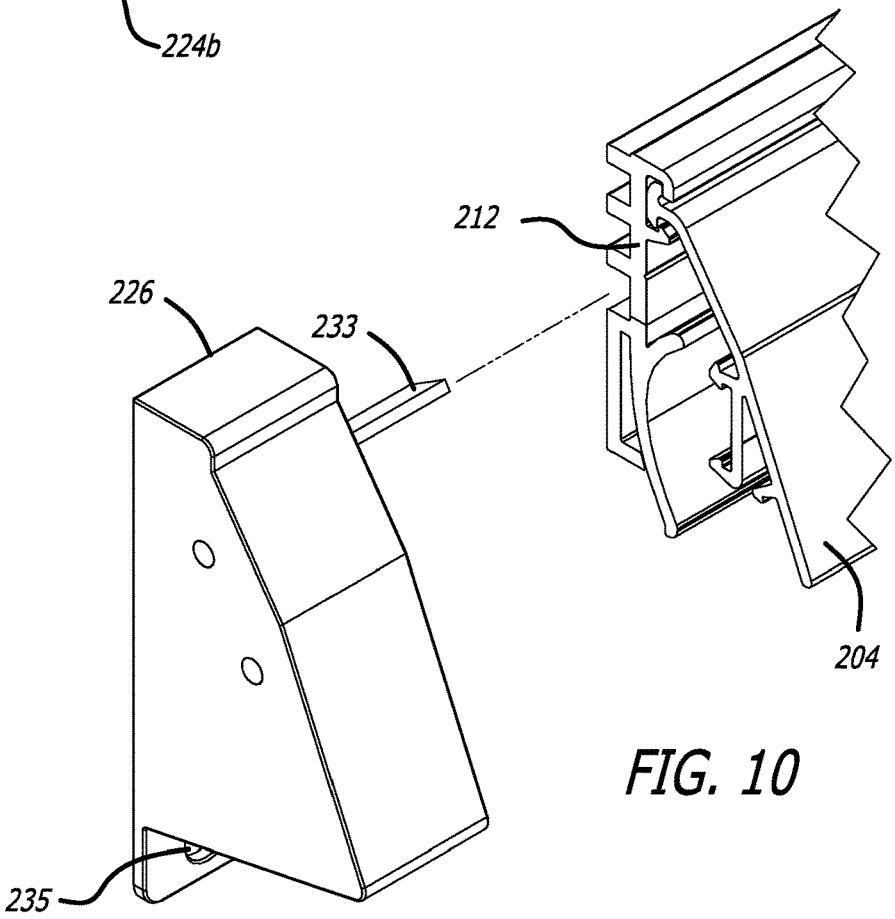
FIG. 10 illustrates an end cap for mounting to an antiglare LED wall light apparatus according to an aspect.

FIG. 10 illustrates an end cap 226 for mounting to an antiglare LED wall light apparatus according to an aspect. As shown, the antiglare LED wall light apparatus comprises the base member 212 with the shield 204 mounted on the base member 212. The end cap 226 may include a support member 233 which slides between structural members 212*a*-212*c* on the base member 212 to provide additional support. The end caps 226 may then be screwed to the wall using the screw hole 235 located on the bottom portion of the end cap.

LED Board

As described above, the light source 203 may comprise an LED board 205 mounted or secured within a holder 207 and the light source 203 may then be mounted within the mounting channel 220 of the shield 204. The holder 207 may include an upper portion and a lower portion, where the upper portion is separated from the lower portion by separating member. The LED board 205 may be adapted for insertion into the upper portion of the holder 207. The one or more wires 209 which provide board to the LED board 205 may extend through the lower portion of the holder 207. In one example, the holder 207 snaps onto the one or more wires 209.

Figure 11:
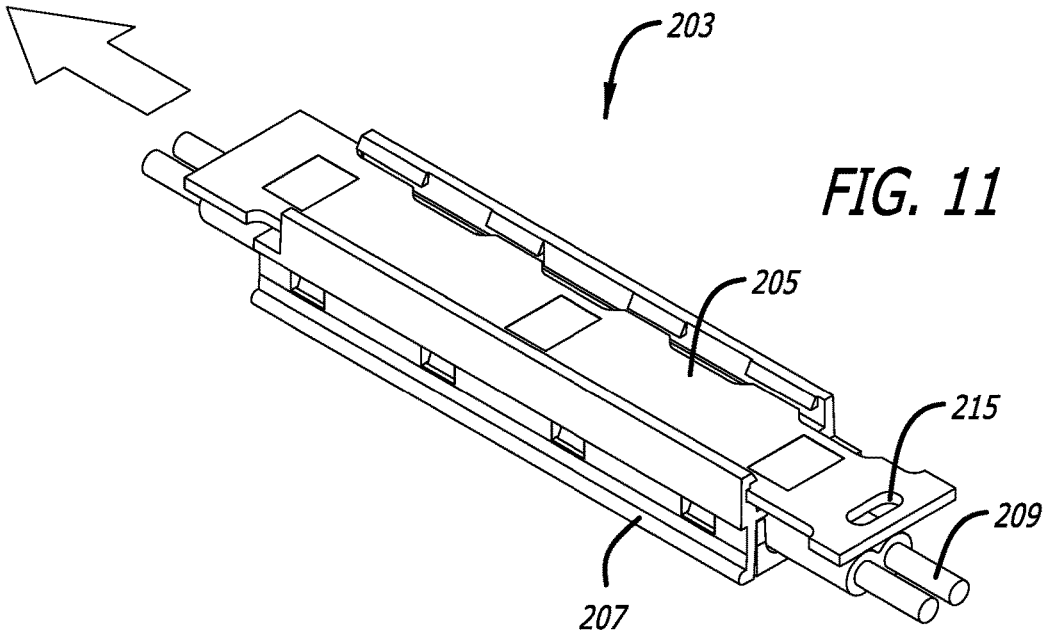
FIG. 11 illustrates a light source having an LED board installed in a holder.
Figure 12:
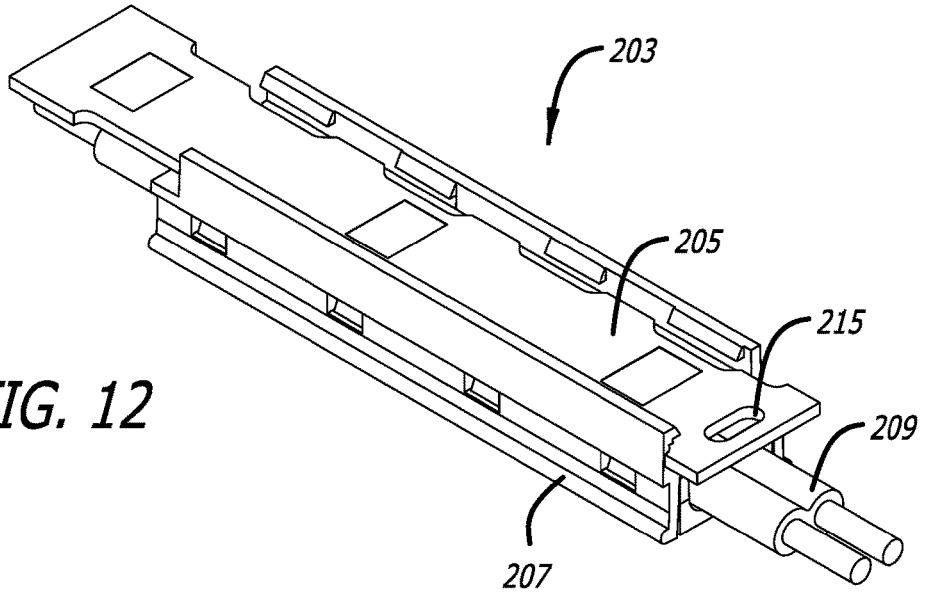
FIG. 12 illustrates the light source of FIG. 11 with the LED board slid sideways from the holder during the removal process of the LED board from the holder.
Figure 13:
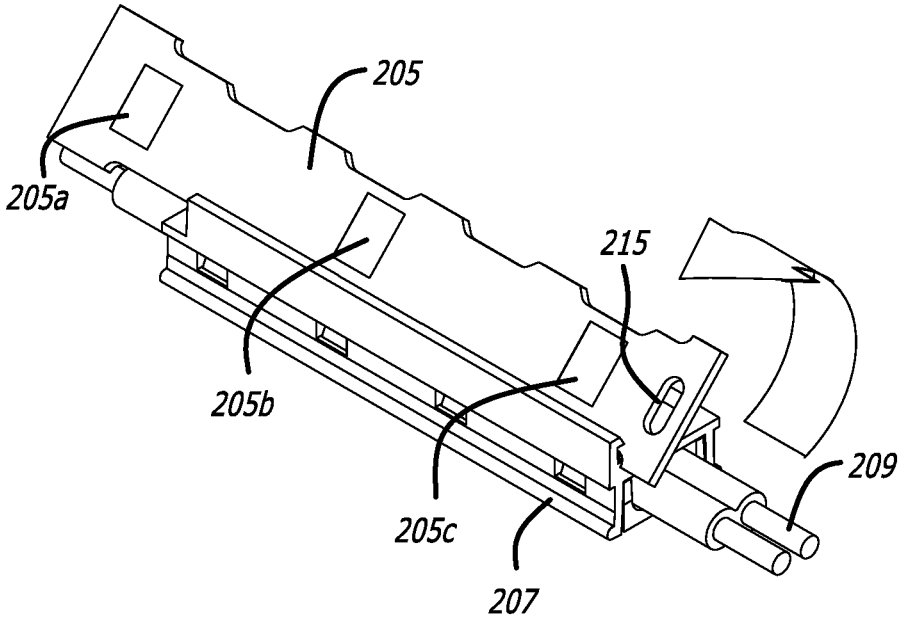
FIG. 13 illustrates a top edge of the LED board rotated upward from the holder during the removal process of the LED board from the holder.
Figure 14:
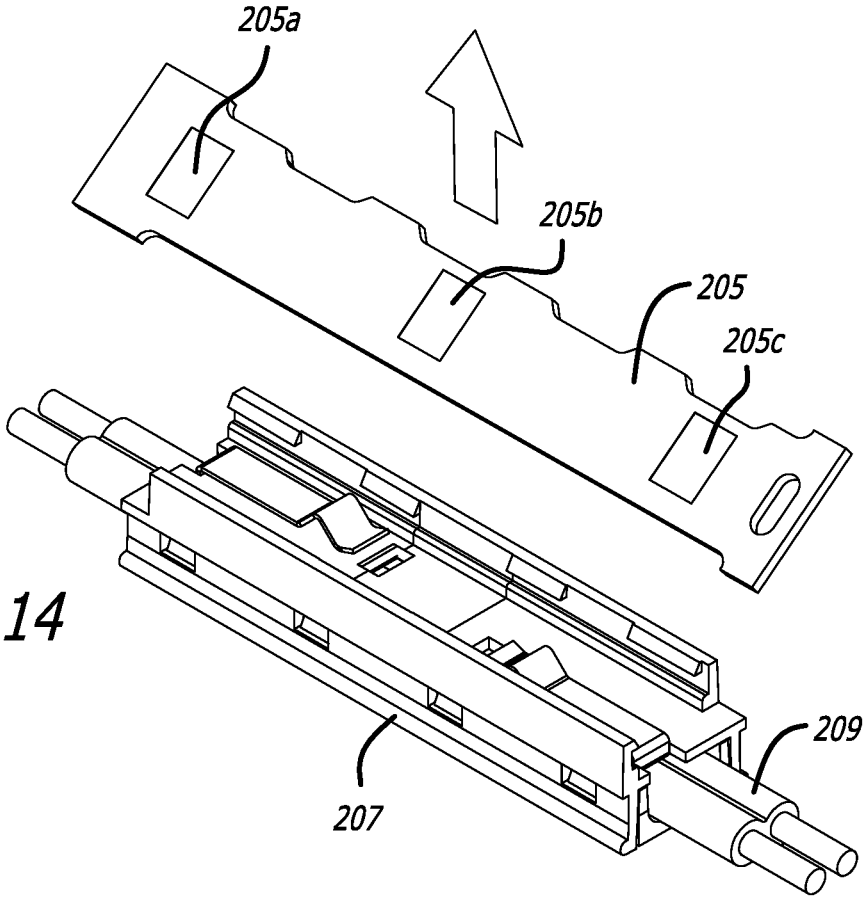
FIG. 14 illustrates the removal of the LED board from the holder.
Figure 15:
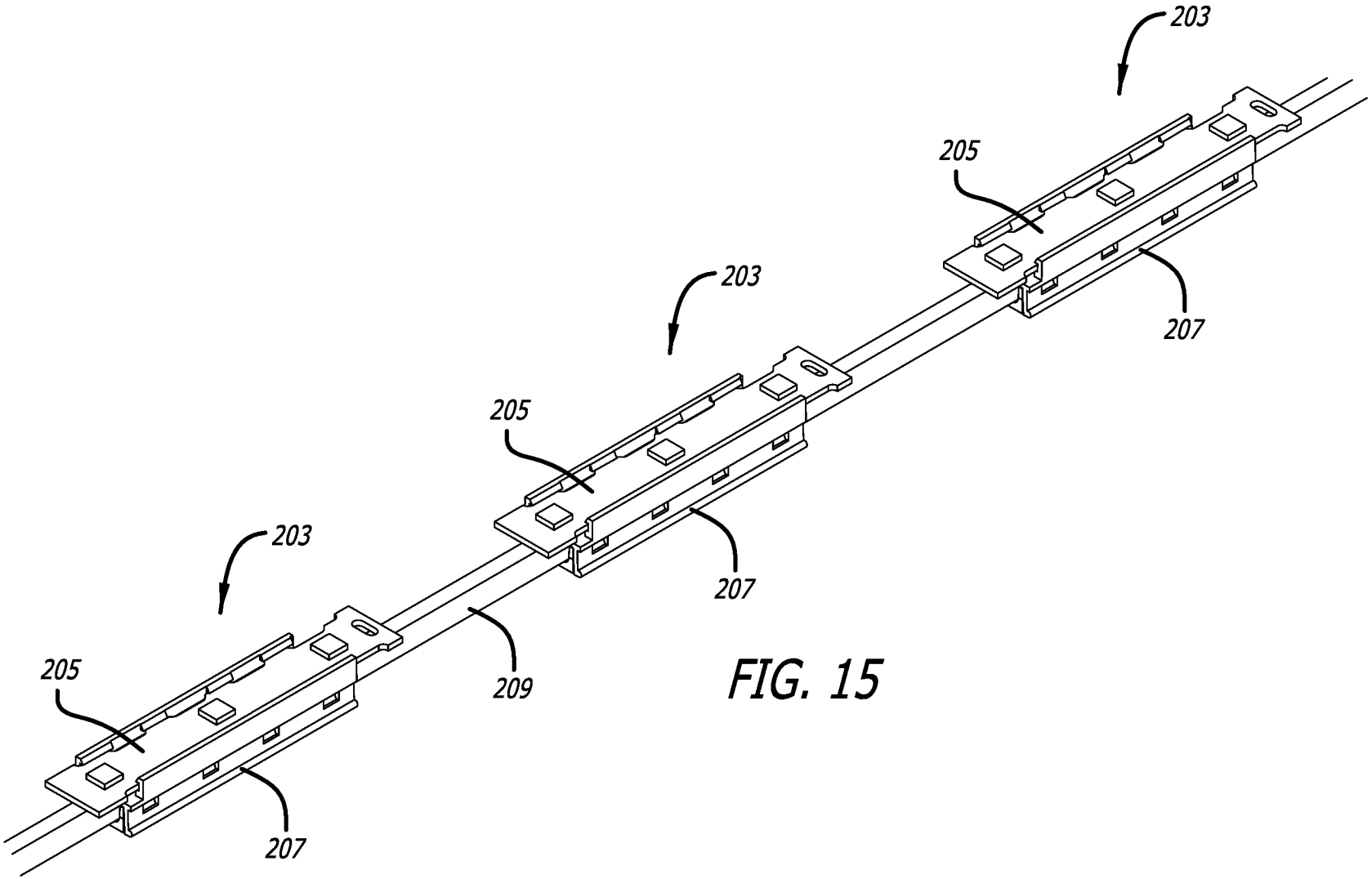
FIG. 15 illustrates multiple light sources mounted or snapped onto a single wire run.
Figure 16:
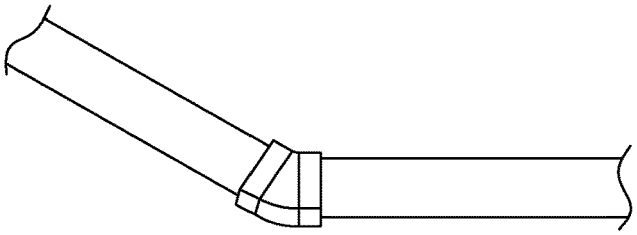
FIGS. 16, 17, 18 and 19 illustrate cover joiners that may be utilized to join multiple antiglare LED wall light apparatuses together.
Figure 17:
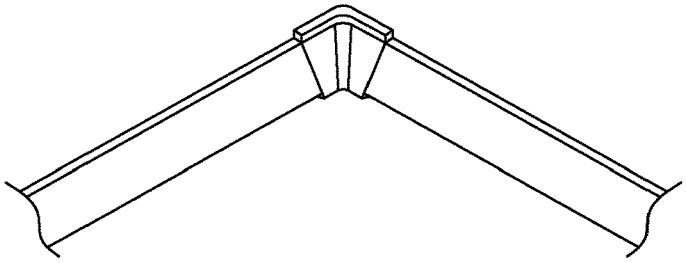
Figure 18:
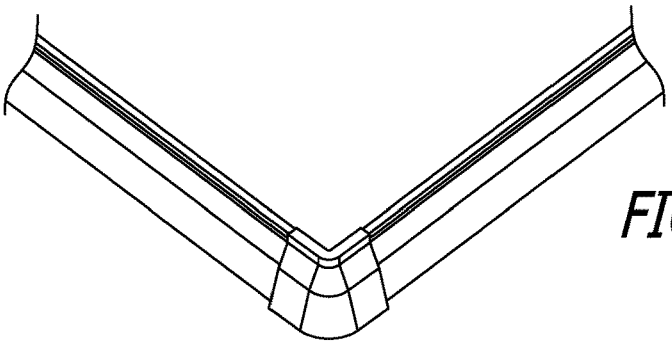
Figure 19:
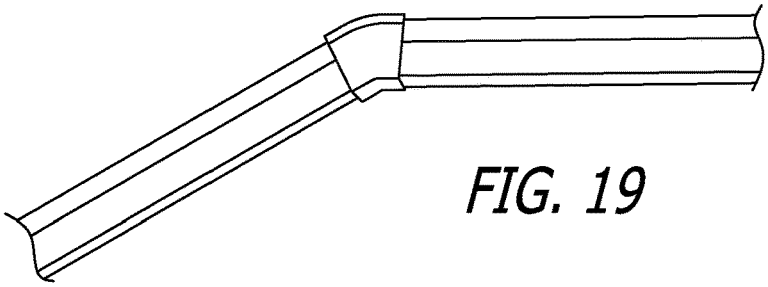

The LED board 205 may be easily removed or installed within the upper portion of the holder 207. Although the LED board 205 illustrates three (3) LEDs 205*a*, 205*b*, 205*c*, this is by way of example only and less than three (3) or more than three (3) LEDs may be located on the LED board 205. FIG. 11 illustrates the light source 203 in an installed position. To remove the LED board 205 from the holder 207, the LED board may be slid sideways, such as to the left, (See FIG. 12). A pointed object can then be inserted into a slot 215 in the LED board 205 at the end of the LED board to allow the LED board 205 to slide more easily. Next, the top edge of the LED board 205 may be rotated upward (See FIG. 13) allowing the LED board 205 to be removed from the holder 207 (See FIG. 14). To install the LED board 205 in the holder 207, these steps are reversed. The easy removal and installation of the LED board 205 allows for easy maintenance to replaced LED boards that are no longer working as well as allowing the LEDs of different colors to be easily installed. Multiple light sources may be mounted or snapped onto a single wire run in the apparatus. For clarity, FIG. 15 illustrates multiple light sources mounted or snapped onto a single wire run without the baffles which the light sources are located between. Multiple light sources located between a pair of baffles and mounted on to a single wire run can be seen in FIG. 5.

Joining Multiple LED Light Apparatuses

FIGS. 16-19 illustrate cover joiners that may be utilized to join multiple antiglare LED wall light apparatuses together. The cover joiners 260 provide for a continuous line between antiglare LED wall light apparatuses and allowed multiple antiglare LED wall light apparatuses to be connected together.

The various features of the disclosure described herein can be implemented in different devices without departing from the disclosure. It should be noted that the foregoing aspects of the disclosure are merely examples and are not to be construed as limiting the disclosure. The description of the aspects of the present disclosure is intended to be illustrative, and not to limit the scope of the claims. As such, the present teachings can be readily applied to other types of apparatuses and many alternatives, modifications, and variations will be apparent to those skilled in the art.

What is claimed is:

1. An antiglare light emitting diode (LED) light apparatus, comprising:

an elongated base member;

an elongated shield detachably secured to the elongated base member;

one or more light sources mounted within the elongated shield at horizontally spaced apart intervals; and one or more pairs of baffles one or more baffles secured to the elongated shield at horizontally spaced apart intervals, where each light source in the one or more light sources is located between a pair of baffles in the one or more pairs of baffles.

2. The apparatus of claim 1, wherein the elongated shield comprises:

an elongated body having an inner surface and an opposing outer surface, the elongated body extending outwardly and vertically downward from an upper end of the elongated body to a lower end of the elongated body;

an arcuate tab integrally connected to the upper end of the elongated body;

a vertical member extending downwardly from the inside surface of the elongated body;

an upper ledge extending horizontally outward from an upper end of the vertical member, the upper end fixedly attached to the elongated body; and a lower ledge extending horizontally outward from a lower end of the vertical member, the lower ledge parallel to the upper ledge forming a mounting channel, the mounting channel configured to receive the one or more light sources.

3. The apparatus of claim 2, wherein the light source includes an upper mounting tab and a lower mounting tab.

4. The apparatus of claim 3, wherein the upper mounting tab is received under a lip of the upper ledge of the mounting channel; and wherein the lower mounting tab is received over a lip of the lower ledge of the mounting channel securing the light source to the elongated shield.

5. The apparatus of claim 2, wherein the elongated shield further comprises a locking ledge integrally connected to and extending outwardly from the elongated body of the elongated shield, the locking edge located below the upper ledge of the elongated body.

6. The apparatus of claim 5, wherein the one or more baffles are secured to the elongated shield by the upper ledge and the locking ledge.

7. The apparatus of claim 1, wherein the elongated base member comprises:

a vertical support member;

a top ledge extending outwardly from a top end of the vertical support member; and a bottom ledge extending outwardly from the vertical support member, the bottom ledge separated from the top ledge by a distance forming a locking channel.

8. The apparatus of claim 7, wherein the elongated shield comprises:

an elongated body having an inner surface and an opposing outer surface, the elongated body extending outwardly and vertically downward from an upper end of the elongated body to a lower end of the elongated body;

an arcuate tab integrally connected to the upper end of the elongated body, the arcuate tab inserted into the locking channel to secure the elongated shield to the elongated base member.

9. The apparatus of claim 8, wherein the top ledge of the elongated base member includes a top ledge extension member integrally connected to an outer end of the top ledge and extending downwardly; wherein the bottom ledge of the elongated base member includes a bottom ledge extension member integrally connected to an outer end of the bottom ledge and extending upwardly; and wherein the top ledge extension and the bottom ledge extension maintain the arcuate tab within the locking channel.

10. The apparatus of claim 8, wherein the arcuate tab of the elongated shield is detachably secured to the elongated base member.

11. The apparatus of claim 7, wherein the elongated base member further comprises an arcuate support member integrally connected to a bottom end of the vertical support member, the arcuate support member configured to the shape of the one or more baffles.

12. The apparatus of claim 2, wherein the elongated base member comprises:

a vertical support member;

a top ledge extending outwardly from a top end of the vertical support member; and a bottom ledge extending outwardly from the vertical support member, the bottom ledge separated from the top ledge by a distance forming a locking channel.

13. The apparatus of claim 12, wherein the elongated base member further comprises an arcuate support member integrally connected to a bottom end of the vertical support member, the arcuate support member configured to the shape of the one or more baffles.

14. The apparatus of claim 13, wherein each baffle in the one or more pairs of baffles comprise:

an upper tab adapted to mount onto the upper ledge of the elongated body of the shield;

a middle tab adapted to mount onto a locking ledge, the locking ledge integrally connected to and extending outwardly from the elongated body of the elongated shield; and a lower tab adapted to mount onto a lower portion of the arcuate support member.

15. The apparatus of claim 1, wherein the light source comprises:

a holder having an upper portion and a lower portion, where the upper portion is separated from the lower portion by separating member; and a LED board adapted for insertion into the upper portion of the holder.

16. The apparatus of claim 15, further comprising one or more wires extending through the lower portion of the holder, the one or more wires providing power to the LED board.

17. The apparatus of claim 16, wherein the lower portion of the holder snaps onto the one or more wires.

18. The apparatus of claim 15 where the LED board includes a slot for enabling removal of the LED board from the holder.

19. The apparatus of claim 12, where the base member further comprises:

one or more horizontal members integrally connected to extending perpendicularly outward from the vertical support member.

20. The apparatus of claim 12, wherein the base member further comprises:

a first horizontal member integrally connected to and extending perpendicularly outward from the vertical support member;

a second horizontal member integrally connected to and extending perpendicularly outward from the vertical support member, the second horizontal member parallel to the first horizontal member; and a vertical structural member integrally connected to outer ends of the first and second horizontal members.

* * * * *